United States Patent [19]

Hensley et al.

[11] Patent Number: 4,799,546

[45] Date of Patent: Jan. 24, 1989

[54] DRILL PIPE CONVEYED LOGGING SYSTEM

[75] Inventors: Donald E. Hensley; E. Edward Rankin; Martin L. Tomek, all of Houston; David M. Moody, Spring, all of Tex.

[73] Assignee: Halliburton Company, Duncan, Okla.

[21] Appl. No.: 111,758

[22] Filed: Oct. 23, 1987

[51] Int. Cl.[4] ..... E21B 23/08; E21B 47/00

[52] U.S. Cl. ..... 166/250; 166/65.1; 175/50

[58] Field of Search ..... 73/151; 166/65.1, 250; 175/50, 61; 340/18

[56] References Cited

U.S. PATENT DOCUMENTS

| | | | |
|---|---|---|---|
| 32,336 | 1/1987 | Escaron et al. | 166/250 |
| 1,715,446 | 12/1987 | Wittrisch | 166/250 X |
| 3,209,323 | 9/1965 | Grossman | 340/18 |
| 4,194,577 | 3/1980 | Vann | 175/4.51 |
| 4,373,767 | 2/1983 | Cairns | 339/94 C |
| 4,384,625 | 5/1983 | Roper et al. | 175/61 X |
| 4,457,370 | 7/1984 | Wittrisch | 166/250 |
| 4,484,628 | 11/1984 | Lanmon, II | 166/250 |
| 4,485,870 | 12/1984 | Walulik | 166/250 |
| 4,488,597 | 12/1984 | Hoppe et al. | 166/250 |
| 4,570,709 | 2/1986 | Wittrisch | 166/250 |
| 4,597,440 | 7/1986 | Pottier | 166/250 |
| 4,664,189 | 5/1987 | Wittrisch | 166/250 |

*Primary Examiner*—William P. Neuder
*Attorney, Agent, or Firm*—William J. Beard

[57] ABSTRACT

A method and apparatus for drill pipe conveyed logging is disclosed. In a highly deviated well borehole, the apparatus comprises a housing for surrounding a logging tool, lockable and releasable rotating standoff means along said housing, and weights along one side to rotate said housing against or relative to the low side of the deviated well bore. The apparatus further includes rotary means joining the housing to the pipe string. A male wet connector enclosed in a sealed capsule is affixed at the top end of the housing and is electrically connected to the logging tool. A cooperative female wet connector in a similar closed capsule is supported on a logging cable. The logging cable is pumped down, mechanical connection is made, separate electrical connection between the mating connectors is made, and drilling fluid is excluded by virtue of positioning the mating connectors in separate closed capsules which are filled with a selected insulating liquid. A method of operation for connection and disconnection is also disclosed.

34 Claims, 7 Drawing Sheets

DRILL PIPE CONVEYED LOGGING SYSTEM

BACKGROUND OF THE DISCLOSURE

Ordinarily, gravity is used to pull logging tools along and into a well borehole for conducting logging operations. When a well is highly deviated, the gravity vector may not draw the logging tool through a deviated portion of the well. Many oil wells are deviated; this is particularly the case at an offshore platform where many wells are drilled from the platform into a targeted formation. While some of the wells might be approximately vertical, most of the wells extending from the platform will deviate at various angles into the formations of interest and some may involve deviations as high as about 75°. Gravity conveyed logging tools supported on wirelines do not necessarily traverse the deviated hole to the zone to be logged. Rather, the logging tool must be pushed through the deviated well to the zone of interest to assure that the logging tool is located at the requisite location in the deviated hole. It is desirable therefore that the logging tool be fixed to the end of a string of drill pipe to assure measurements along the deviated well and orientation of the logging tool at the zone of interest.

In a deviated well, the logging tool must be initially positioned in the open borehole to assure that the logged data is properly referenced to the zone of interest. In a vertical borehole, the logging tool typically will be positioned axially of the borehole. In fact, successful logging can be obtained with tools which are centralized in the open borehole and also for those which are forced to the side of the borehole for decentralized operation. The present system is particularly able to support all types of tools in a logging tool assembly and position the decentralized tools so that they are located in a known position relative to the gravity vector.

Consider a deviated well where the well is more than 10,000 feet from well head drilling apparatus to the zone of interest. Assume further that the deviated portion of the well is at a high angle, perhaps as high as 75° or 80° with respect to vertical. The high side of the hole with respect to the gravity vector is the top of the borehole while the low side is the bottom of the deviated borehole. In this example, if one desires to position a logging tool in the deviated region, the logging tool is positioned so that the decentralized tool faces the low side of the deviated borehole. Should the tool be at some other angle, then rotation of up to 180° must be imparted to the logging tool. This has been handled in the past by incorporating some kind of motor between the drill string and the logging tool. The motor is rotated to thereby rotate the logging tool until it is properly positioned relative to the gravity vector. If the motor is omitted, the entire drill string can be rotated from the well head. This is not particularly desirable because rotation from the well head may require substantial rotation on the drill string before the logging tool is rotated. The drill string comprised of steel pipe responds as a resilient member and may absorb some rotation and thus will not deliver the required rotation in a controllable fashion. In other words, carefully calculated rotation cannot always be imparted from the well head to the logging tool through the resilient drill string. Rather, the rotation of the tool will be irregular, subject to snagging, or the rotation may be absorbed entirely in the drill string. It is a matter of chance that the drill string can manipulate the logging tool to the proper decentralized orientation relative to the high side and low side of the deviated well.

The present invention sets forth a method and apparatus in which the logging tool can be positioned so that the high side of the hole is properly oriented to the high side of the logging tool. The present apparatus supports a logging tool so that it seeks the low side of the hole and stays oriented at all times in the deviated well. By contrast in the vertical wells, azimuthal orientation is not usually important. When the deviated portions are encountered, the present apparatus positions at all times the logging tool so that it is decentralized and positioned against the low side of the borehole. This is true without regard to the angle of deviation. That is, it can be used where the well is deviated perhaps only 30° but is also can be used where the deviation approaches the horizontal.

The logging system of the present disclosure further includes a connector system which enables deferred connection of the logging cable to the logging tool. This is highly desirable so that movement of the drill string occurs without involving the logging cable. The drill string is assembled with a side entry sub located in the drill string. The side entry sub is positioned in the drill string at a specified depth, as will be explained, below the well head. The drill string is maneuvered until the logging tool is at the start of the zone of interest. Then, the mud flow through the drill string is used to force a wet connector with associated apparatus along the drill string to land in contact with the mating connector at the logging tool. This deferred connection of the electrical conductor with the logging tool permits all the maneuvers to be completed prior to the actual logging sequence. Thus, the logging tool is at the zone of interest, poised for logging sequences to be conducted in that zone, properly oriented with respect to the gravity vector, appropriately decentralized, and positioned against the low side of the deviated well. At this juncture, the next step is to begin adding drill pipe to the string at the surface to force the logging tool through the zone of interest. In this posture, a momentary interruption is encountered while the mud flow is used to force the wet connector and associated logging cable through the drill string until it lands at the logging tool. Connection is made and the logging procedure is then started. When the wet connector is pumped down, there is no need to reposition the logging tool because the position is already assured relative to the zone of interest. Ordinarily, logging proceeds by retrieving the logging tool from the borehole. Assume as an example that the zone of interest encompasses 500 feet of the deviated well. The logging tool is initially pushed to the top of the 500 foot zone, the wet connector is pumped down, connection is made, and then 500 feet of drill pipe is added and pushed beyond the the 500 ffoot zone. Then 500 foot of drill pipe is removed at the surface during logging on tool retrieval. The drill pipe is first simply pushed into and then pulled from the deviated well. This pushes the properly oriented logging tool to the end of the 500 foot zone. Then, the 500 foot of drill pipe is removed one joint at a time as the logging tool is pulled back through the 500 foot zone of interest. Logging occurs at the necessary locations appropriate for the investigation. At all points in time, the logging time is properly oriented relative to the gravity vector in the zone of interest so that it is positioned for obtaining data with proper orientation. As noted above, this orientation also includes proper contact relative to the walls of the open borehole which controls tool standoff to the formation.

At the time of connection between the wet connectors, pump down forces the logging cable connected to a weight bar and a female wet connector through the drill string. This exposes the mating connectors to very high ambient pressures, 10,000 psi or higher. The drill string is filled with drilling mud which seriously interferes with proper operation of the wet connectors. The wet connectors are shielded so that they are not exposed to the drillng mud at the contact area. So to speak, the contacts are wiped clean before mating contact is made. This mating system in conjunction with a latching system accomplishes connection at a controlled rate. This overcomes excessive velocity of the female wet connector should it bang or jolt the male wet connector. Thus, latching is achieved controllably with a locking stroke whereby the cooperative connectors are wiped before connection, telescoped together, brought into operative electrical connection, latched, all in a secure location without regard to the external environment.

The present disclosure is thus summarized as a drill pipe conveyed logging (DPCL) system which supports a logging tool in a protective housing equipped with rotary standoffs to control standoff spacing. The housing is aligned with the drill pipe and encloses the logging tool on the interior. The housing protects the entire tool except that certain portions are cut away. This permits backup shoes to extend from the housing. The backup arm (caliper) is used to measure the diameter of the borehole. Normally, it does decentralize the logging tool. However, decentralization is achieved by other means. Moreover, the logging tool is forced to the low side of the deviated well by incorporation of a low side weight system therein. This in conjunction with the rotary standoffs assures proper orientation. The upper end of the protective housing encloses a male wet connector in conjunction with a serial centralizer thereabove to guide and direct the female wet connector into contact. The wet connectors achieve the desired connection with shielded contacts making the actual electrical connection. The apparatus and a method of use will be set forth in greater detail hereinafter on reference to the drawings in conjunction with the written specification found below.

DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
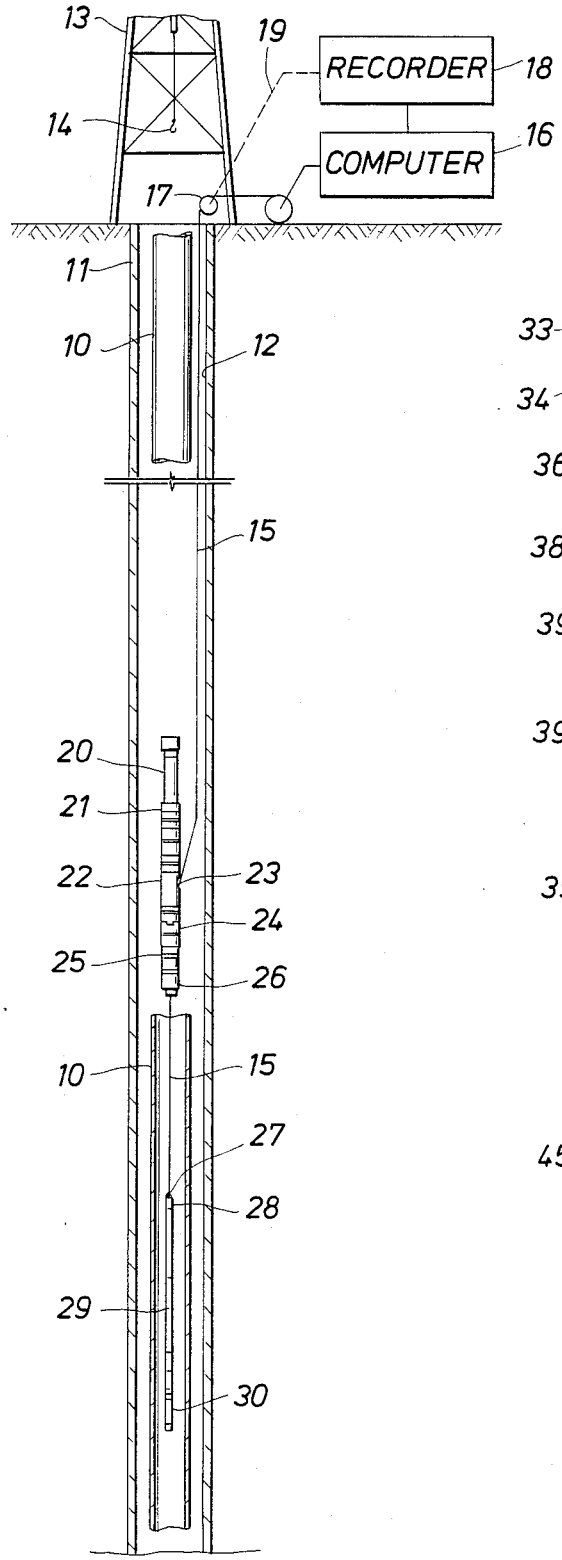
FIG. 1 shows a drill string in a borehole for conducting logging operations in a deviated well wherein the drill string incorporates a side entry sub enabling a logging cable to extend to the interior of the drill string and thereby position a female wet connector to be pumped along the drill string.

In FIG. 1 of the drawings, the numeral 10 identifies a drill string in a well 11, the well being lined with casing 12 to a specified depth. The drill string 10 is supported by a derrick 13 with a draw works 14 to be raised and lowered. Through the use of suitable mud pumps (not shown), drilling mud is pumped into the drill string 10 and flows through the drill string to carry out drilling operations. In the arrangement shown in FIG. 1, the drilling has been interrupted and a logging sequence has been initiated. The equipment located at the derrick 13 also includes a multiconductor logging cable 15 which connects with a computer 16 for processing the data provided over the multiple conductors typically found in the logging cable 15. The logging cable passes over a sheav 17 and depth of cable is transmitted to a recorder 18 by means of a depth measuring apparatus 19. The cable length is measured to ascertain the depth of the logging tool. An alternate mode of depth measurement is to tape the drill string 10 and thereby calculate the depth of the logging tool in the well 11. The drill string 10 threads to a tool joint 20 which threads to an actuator section 21 located above a side entry sub 22. The side entry sub 22 has a port 23 which permits the logging cable 15 on the exterior of the drill string 10 to pass through the port and in the interior of the drill pipe. In other words, the cable 15 is both on the interior and the exterior of the drill string. Crossover is made at the side entry sub 22. This positions a connector to be described in the drill string. The side entry sub is just above a release section 24 which then connects with an installation sub assembly 25 and that in turn connects with another tool joint of conventional construction indicated at 26. This tool joint enables continuation of the drill string with conventional joints of drill pipe having a specified internal diameter.

FIG. 1 further shows the logging cable 15 on the interior of the drill string. It supports a fishing neck 27 which in turn is adjacent to an enlargement serving as a piston 28. The enlargement 28 is fairly large compared with the ID of the drill string so that drilling mud pumped down through the drill string will force the piston downwardly. The enlargement 28 supports a weight bar 29 to provide adequate weight on the female wet connector 30 at the lower end. The weight bar 29 joins to the female wet connector 30, enclosing multiple conductors for the logging cable 15. The female wet connector will be described in detail in conjunction with FIG. 6 of the drawings. Suffice it to say at this juncture that the connector 30 incorporates a set of mating electrical contacts sufficient to provide multiple signal paths out of the drill string. Moreover, the weight bar urges the female connector into coacting joinder with the male connector to assure proper match of the electrical contacts. The female connector 30 is thus forced through the drill string to the lower end for connection with the apparatus shown in FIG. 2. It should be further noted that the side entry sub 22 is ideally located in the cased portion of the well which is generally vertical. This location avoids exposing the logging cable 15 to the risk of abrasion on exposure in open hole conditions. Typically, the casing 12 extends down to a specified depth and for that reason, it is desirable that the side entry sub be confined in the cased region and not expose the cable to open hole conditions therebelow. Typically, the side entry sub is spaced in the drill string below the well head by a distance limited by the depth of casing in the well 11.

Figure 2:
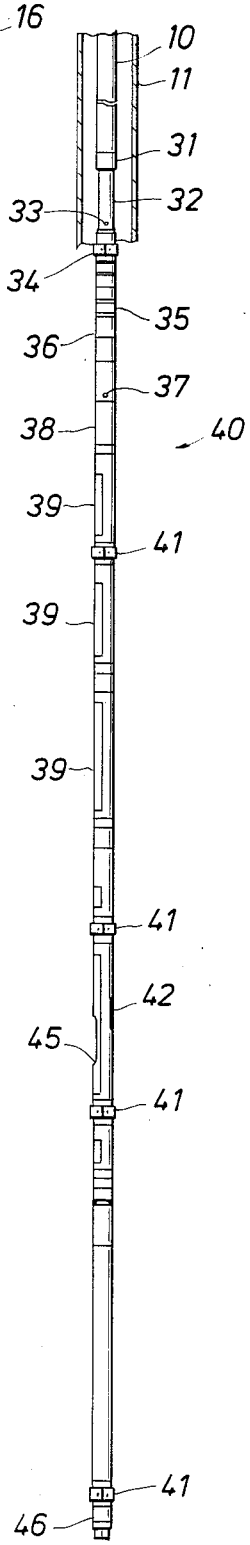
FIG. 2 is an external view of the protective housing affixed to the lower end of a string of drill pipe and adapted to conduct logging operations in a deviated well.

Going now to FIG. 2 of the drawings, the open hole 11 is shown with the drill string 10 therein. At this juncture, the hole can be vertical but it can just as readily be highly deviated and for purposes of description, it will be assumed that the left side of FIG. 2 is the low side of the deviated well while the high side is at the right. The angle of deviation can be any angle which is typically encountered, and indeed, the hole 11 can be horizontal at this region. Assuming that the hole is highly deviated or even horizontal, the left side of FIG. 2 will be described as the low side or the side at which the decentralized tool is positioned. The high side is the opposite side or the right hand of FIG. 2.

Assuming for purposes of description that the structure shown in FIG. 2 is on its side with the right hand side of FIG. 2 being the high side, the drill string connects with a tool joint 31 which in turn joins to a handling sub assembly 32 having circulation ports therein identified at 33. This permits mud to escape out of the tool string. There is an encircling standoff assembly 34. This standoff assembly can be located against rotation. It supports an orientation sub assembly 35. That in turn joins to the protective housing identified generally at 40. The protective housing 40 encloses the logging tool 50 better shown in FIG. 3 of the drawings. Going back to FIG. 2, however, the orientation sub assembly 35 connects serially to a centralizing section 36 which will be shown in greater detail in FIG. 4 of the drawings for centralizing the female wet connector 30 supported on the logging cable 15. The male connector to be described is located at the lower end of the centralizing section 36. Again, circulation ports are included at 37.

The protective housing 40 includes an external cylindrical shell 38 of substantial length. At selected locations, it supports a counterweight at the left. The counterweight 39 has the form of a semicircular saddle. It is repeated at multiple locations to provide adequate weight to assure that the counterweights fall to the bottom of the well bore 11. The cylindrical shell 38 preferably does not touch the sidewall of the borehole. Contact is provided by means of a rotating standoff assembly 41 which is repeated at several locations. The various locations are interspersed along the length of the protective housing so that physical contact is limited to the standoff assemblies. In the event that they wear, they can be readily replaced without having to replace the elongate cylindrical shell 38 which is the exterior of the protective housing. The counterweights can also be located on the exterior and serve as a scuff surface which is wear resistant.

Figure 3:
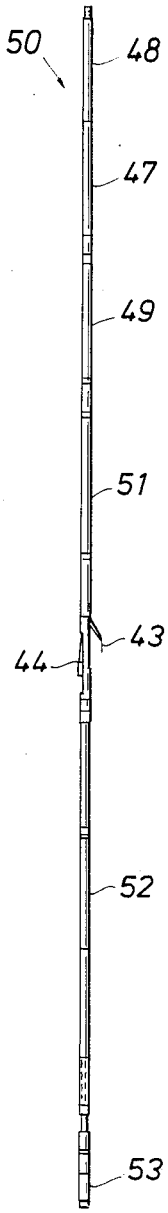
FIG. 3 is a view of the logging tool for the protective housing shown in FIG. 2.
Figure 4A:
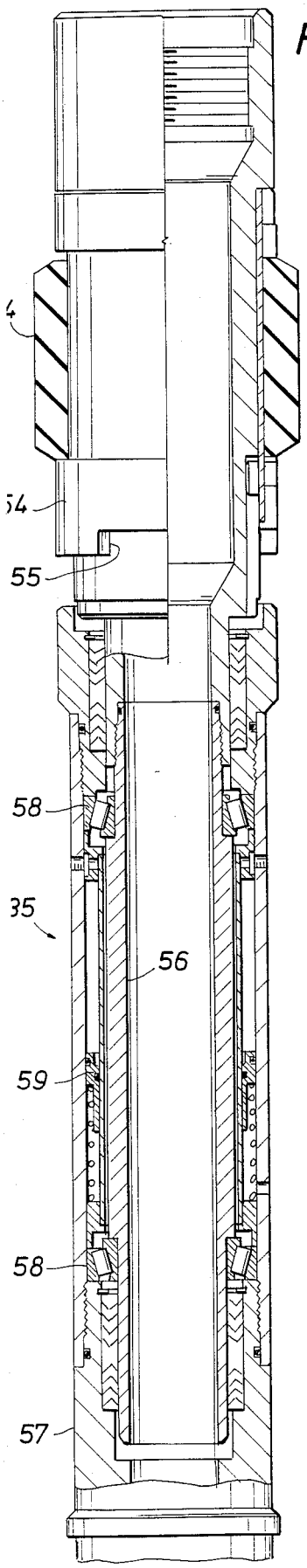
FIGS. 4A-4J is the protective housing including an upper centralizer portion connected in the drill string, FIG. 4 being divided into several segments primarily in sectional view showing apparatus in the several views.
Figure 4B:
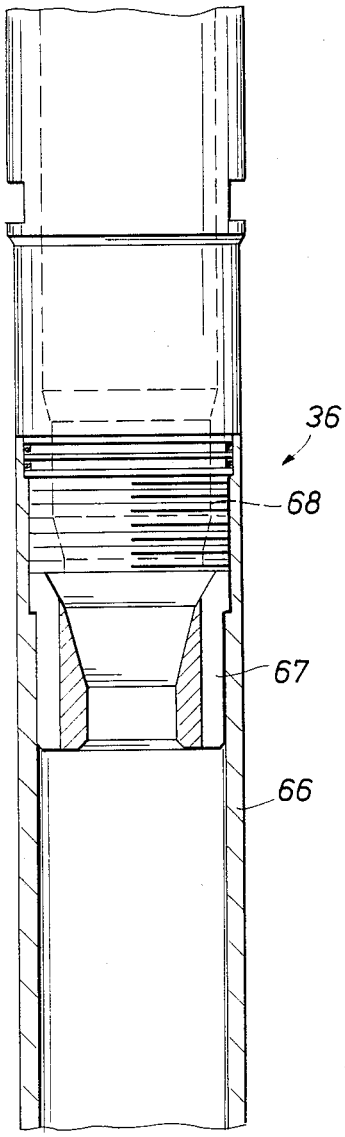
Figure 4C:
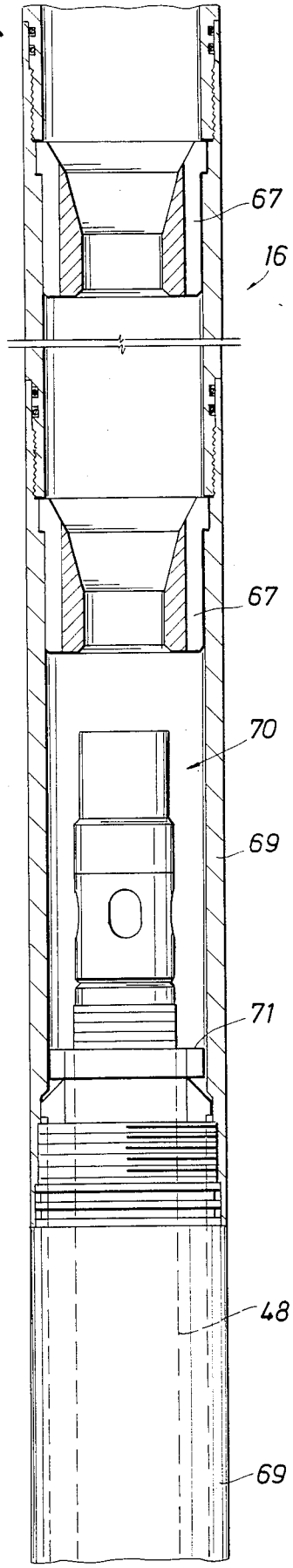
Figure 4D:
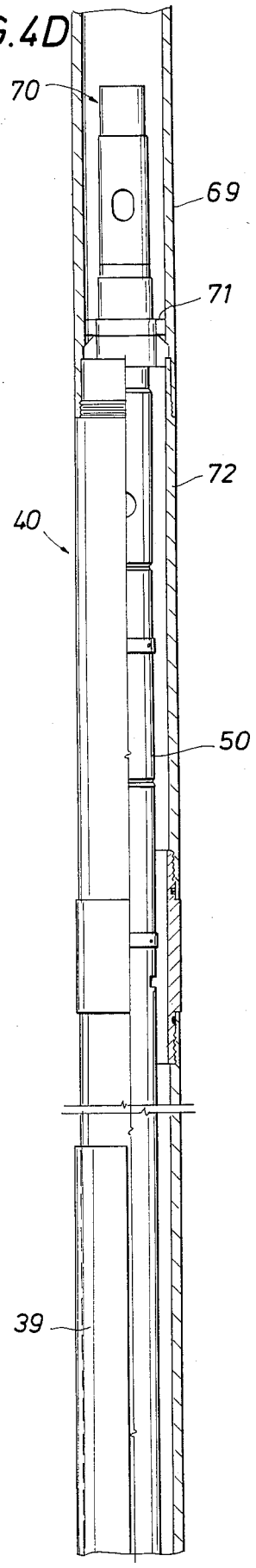
Figure 4E:
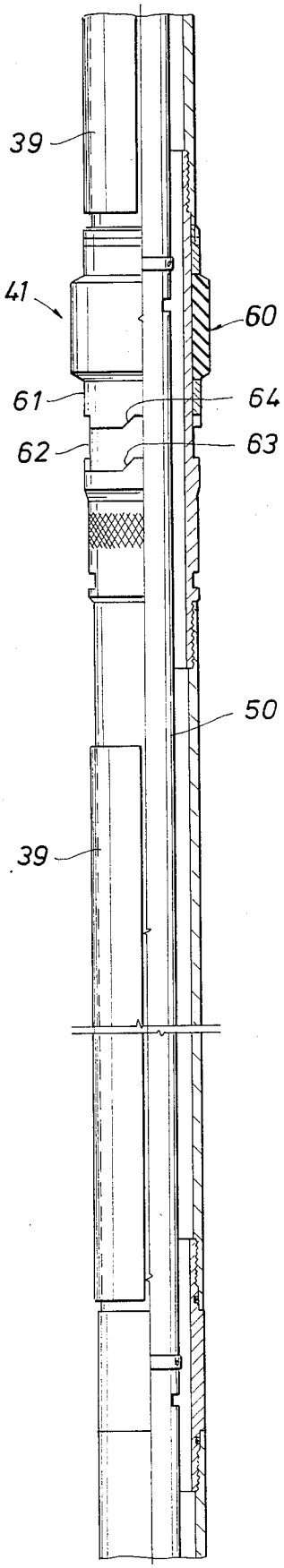
Figure 4F:
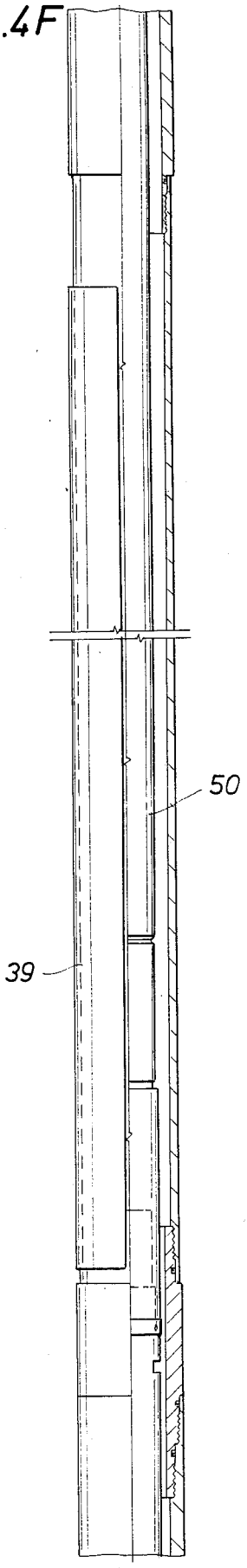
Figure 4G:
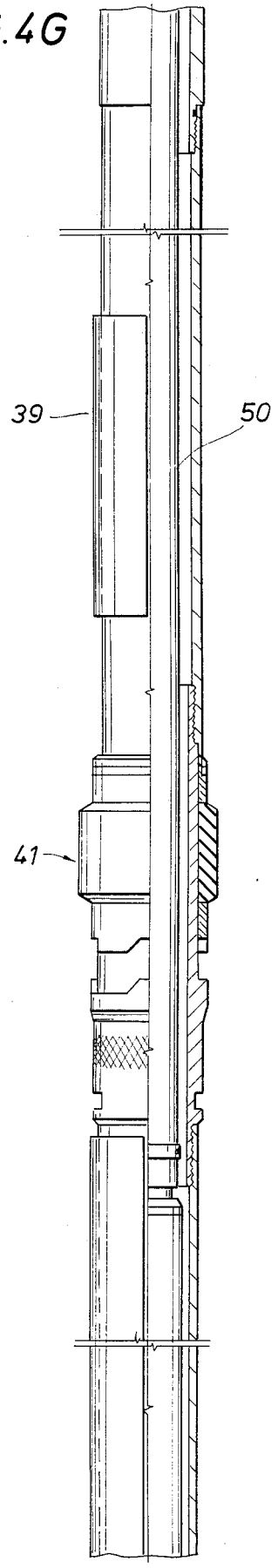
Figure 4H:
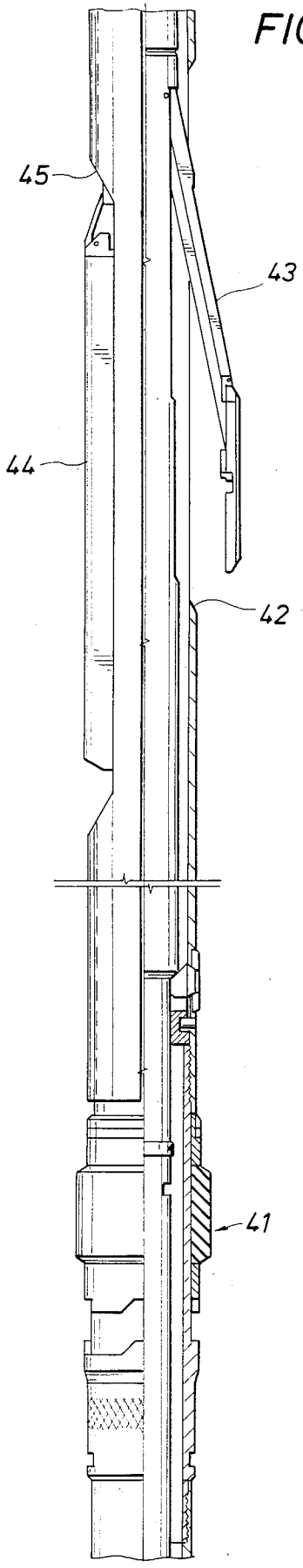
Figure 4I:
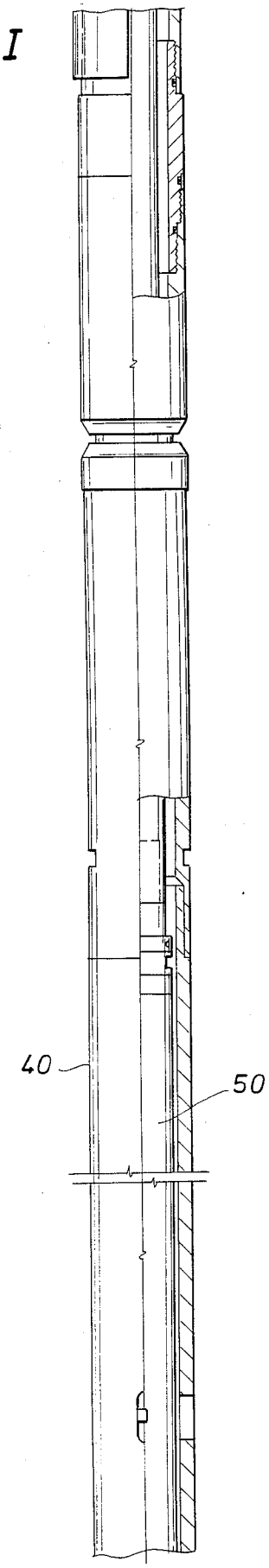
Figure 4J:
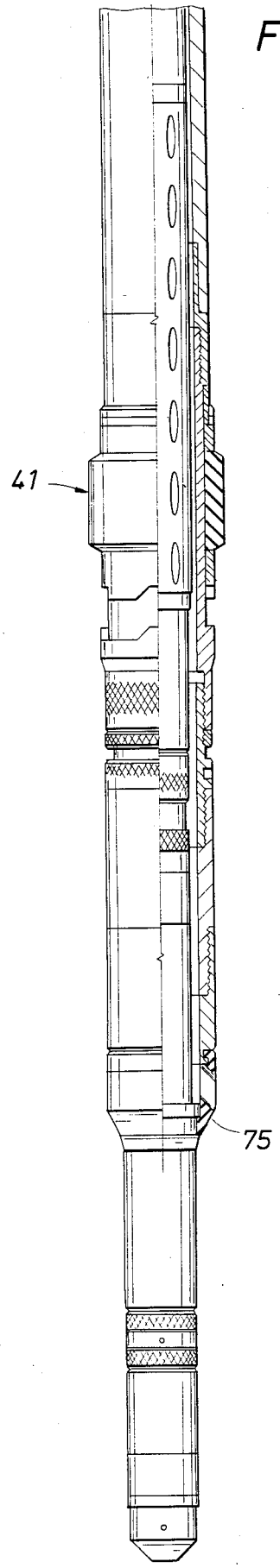

The housing shell 38 comprises a protective cylindrical shroud or housing which receives the logging tool 50 on the interior. The housing is made of metal or other materials depending on the nature of the tool as will be discussed. Normally, the tool 50 is centralized on the interior of the housing 40. However, the housing itself may not be centralized with respect to the well 11 so that the tool 50 is normally positioned on the low side of the open hole, and particular logging tools are brought into close contact with the sidewall. This is accomplished at the region where appropriate slots are formed in the housing 38. There is an arm slot 42 which enables a cooperative projecting arm 43 to extend therethrough. The arm 43 is shown in FIG. 3 and is deployed outwardly. This positions a pad assembly 44 against the low side of the well 11. It is forced against the sidewall to assure proper contact and thereby obtain logging information. The pad 44 is permitted to extend through the conforming and shaped opening 45 which is opposite the arm slot 42 previously mentioned. The respective slots are located between a pair of closely spaced rotating standoff assemblies 41 to assure that the pads and arms are able to move properly into the necessary positions for proper contact.

The assembly shown in FIG. 2 terminates at a nose cone assembly 46 at the lower end. Conveniently, the protective housing 40 can have a length of perhaps upwards of 30 feet or so depending on the length of the various logging tools placed on the interior. This length can be increased to accommodate an increase in logging tool 50 length.

The logging tool 50 includes an upper section which is a telemetry section 48. It in turn connects with several different tools. As an example but not as a limitation, one such tool is a natural gamma ray measuring apparatus 47. Another is a dual spaced neutral measuring tool 49. A spectral density tool 51 is also included and is a device which utilizes the arm 43 along with the pad 44 which protrude out of the housing. The housing is provided with the appropriate slots. The several components which make up the logging tool 50 also include a dual induction log tool 52 provided with a short guard 53 at the lower end. Again the precise combination of logging tools included in the logging tool 50 can be varied so that the length can be varied, and the tools can be characterized as those which require pads in contact with the sidewall or those which do not have such requirements. In summary, the logging tool 50 is placed in the housing 40 shown in FIG. 2 and the various data observed by the logging tool 50 are provided to the telemetry system 48 which then converts the data into suitable formats for transfer to the surface. The housing 40 is filled with drilling mud to equalize pressure. No particular harm arises from entry of mud in view of the fact that the logging tool 50 is made of sealed components which exclude drilling mud.

DETAILED DESCRIPTION OF THE PROTECTIVE HOUSING

Going now to FIG. 4 of the drawings (shown in several serial sectional view from the top of the tool to the bottom), the top sectional view shows the orientation section 35 previously mentioned. The orientation section 35 is constructed with the locked stand off ring 34 attached in such a fashion that it is fixed to the entire drill string thereabove. It cannot rotate because it is fixed on a telescoping sleeve 54 which is able to rotate when it is moved upwardly, but rotation of the apparatus below is forbidden in the down position by the interlocking position of the facing shoulders 55. It is constructed around an internal, elongate tubular sleeve 56 joined to the drill string above. The sleeve 56 is fixed to the drill string above and moves with the drill string. The sleeve 56 is reduced in diameter to support a telescoping outer sleeve 57, the sleeve 57 being supported for rotation by means of spaced bearing assemblies at 58. The two bearing assemblies face one another and are constructed with thrust radial bearings to assure proper alignment with rotation of the telescoped components. In the annular space, a floating seal ring 59 is spring balanced upwardly and downwardly to assure pressure equalization of lubricant on one side of the floating seal ring 59. In other words, dynamic pressure observed at the depth in the bore hole is transferred through the drilling mud into the annular space and acts on the seal ring 59 to thereby pressurize lubricant for the bearing assemblies 58. The bearings 58 are lubricated and maintained in a lubricant bath to avoid pollution with drilling mud from the exterior. Lubricant is contained in the system by the upper and lower seal assembly. Lubricant is injected through a fill plug. The ambient mud pressure in the well assures pressurization of the lubricant captured in the annular space between the two members telescoped together.

The centralizer 36 is shown therebelow and includes an elongate cylindrical housing 66. This comprises a portion of the drill string. On the interior, there is a centralizing ring 67 which includes an external shoulder locking with a mating shoulder formed on the interior of the housing 66. The internal axial passage is tapered at 68 to direct equipment along the center line into the centralizer 67. The centralizing ring 67 is included at a first location and is replicated at additional locations therebelow as shown. The several centralizers serve as a guide for the female wet connector which traverses the lengthy drill pipe.

The numeral 70 identifies the wet male connector. It will be described in detail hereinafter. It is included in an additional housing section 69. This housing section, however, is almost blocked by the connector 70. The connector 70 is supported by an alignment ring 71, and is positioned on the center line axis of the housing 40 and also is connected into the upper end of the subsurface telemetry unit 48 previously discussed with regard to FIG. 3. The surrounding external housing 69 extends along the enclosed telemetry unit 48. The logging tool 50 on the interior has an indefinite length and it is constructed with an external shape and size which fits within the protective housing 40 previously defined.

The male wet connector 70 is supported by a threaded, lug equipped ring 71 which centers the male wet connector in the housing 40. For convenience in fabrication and assembly, the housing 40 is made of several threaded members joined together including the cylindrical member 69. The next outer tubular member is identified by the numeral 72. The annular gap between the protective housing 40 and the equipment on the interior permits mud to flow along the interior. This assures a hydrostatic pressure balance across the protective housing 40. In addition, the housing 40 is equipped with a semicircular sleeve 39 which serves as a balance weight. It is located around approximately 180° of the cylindrical housing. The weight 39 is a semicircular structure which is conveniently placed on the exterior and can be made of wear resistant material to function as a scuff pad. Several such weights 39 are placed on the structure. They are included to rotate the tool 50 to the proper orientation regarding the high side and low side of the hole. The standoff 41 has the form of a cylindrical ring 60 constructed around the exterior of a sleeve 61. The sleeve 61 slides on a central sleeve 62 and is free to rotate in the position shown in the drawings. However, movement of the sleeve 61 downwardly engages a projecting locking shoulder 63 into a conforming notch 64. Shoulder and notch locking prevents rotation. The sleeve 61 is free to ride up and over the notch shoulder 63 to rotate. The standoff 41 contacts the sidewall of the open hole and thereby prevent scuffing. On retrieval, the sleeve 61 slides down to lock against rotation. Disengagement of the sleeve 61 is by movement upwardly. Rotation against the shoulder 63, however, sustains the locked position of the sleeve 61. The rotating standoff assemblies 41 function in the same fashion previously given, namely, they permit rotation when the tool is being forced down hole, but they lock against rotation when it is being retrieved up the well.

This enlarged view of FIG. 4 shows in greater detail the slot 42 on the high side of the tool permitting the back up arm 43 to extend radially outwardly the instrument pad 44 is brought into proper contact with the sidewall. This requires that the slots 42 and 45 have a specified length and width to enable the arm and pad to protrude out of the protective housing 40. This assures that proper operation can be obtained. Moreover, this enables tools equipped with such arms and protruding pads to be protected in the housing 40 and yet to accomplish their intended function.

At the lower end of the system shown in FIG. 4, the protective housing 40 tapers inwardly at 75 and fits snugly around the logging tool 50 on the interior and particularly enables the short guard 53 shown in FIG. 3 to be partially exposed on the bottom of the tool assembly. It is out of the housing 40 which terminates and partially covers the short guard. It will be observed that there is an annular space between the logging tool 50 and the protective housing 40 about the logging tool. Drilling fluid fills this region so that pressure equalization is obtained along the full length of the housing 40. In the usual fashion, the logging tool 50 is constructed so that it is hermetically sealed against external fluid and is able to withstand the ambient pressures encountered in downhole operations.

DESCRIPTION OF THE MALE WET CONNECTOR

Figure 5A:
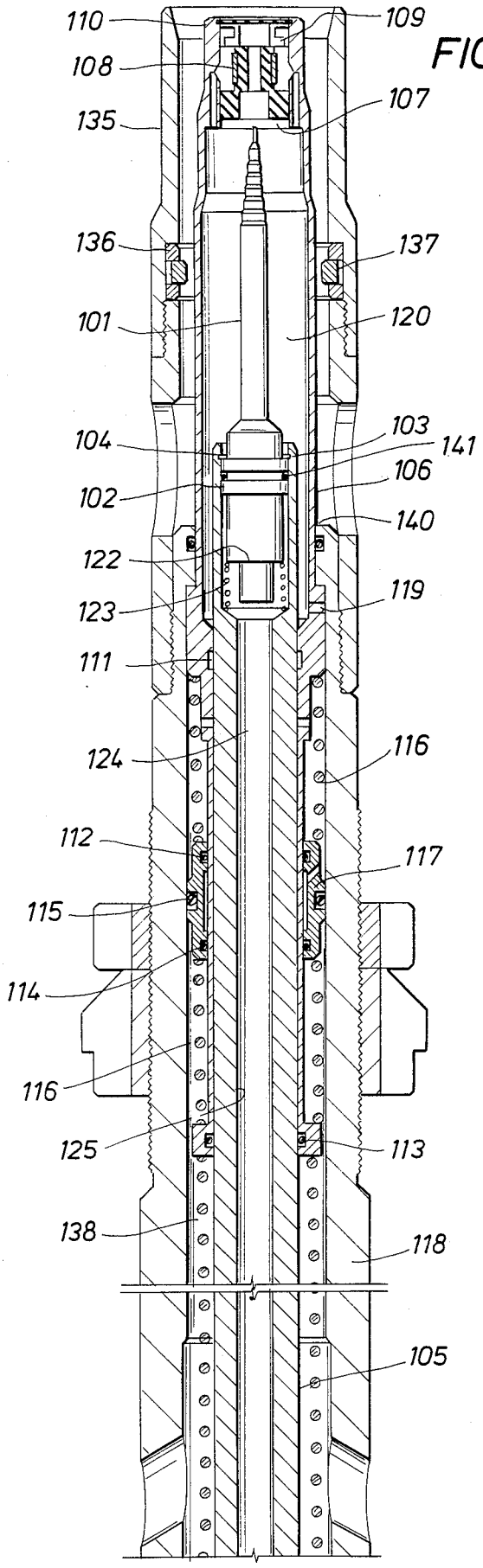
FIGS. 5A & 5B are sectional views through the male wet connector installed in the protective housing of FIG. 4.
Figure 5B:
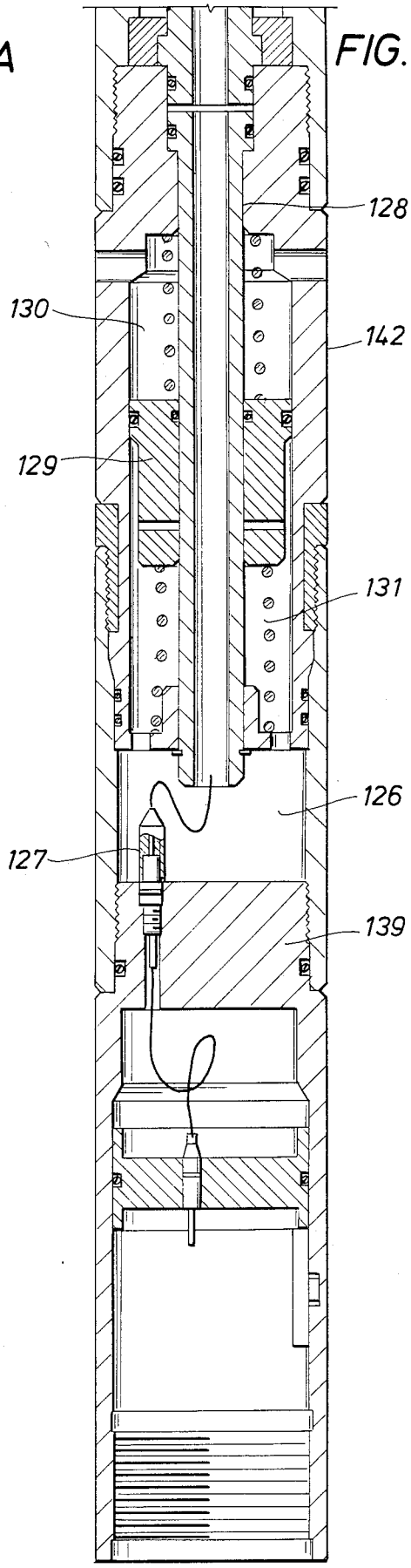

The male wet connector 70 in shown in sectional view in FIG. 5 of the drawings. For ease of description, all the components therein will be assigned reference numerals of 100 or more while the female wet connector 30 to be described in FIG. 6 will be assigned reference numerals of 200 or more. Recall that the primary goal of the two connectors is to come together and provide a multitude of connective paths so that the logging cable can be selectively lowered in the drill string after the drill string has been placed in the bore hole and has been pushed to the requisite location for logging operations. In other words, a significant portion of the procedure is undertaken with no electrical connection to the logging tool. When the time is appropriate, connection is then made. Connection is made with the express purpose and view of recovering data from the logging tool 50 during the logging sequence. This avoids the necessity of leaving the logging cable connected and, indeed, there is an advantage to disconnection except during the logging sequence as actually undertaken whereby the drill string has pushed the logging tool 50 to the far end of the formation zone of interest, and the logging tool is then retrieved through the zone.

The wet connector 70 includes the multiconductor, multi-terminal probe 101. It is constructed in the fashion of a jack probe which has a multiple conductive areas which taper to the tip. It tapers from the tip to a large diameter central shaft and terminates at a base. The base is secured by a retaining ring 103, the ring securing the enlarged base for movement within a surrounding sleeve 104. The sleeve 104 is appended to the near end of an elongate rod 105 which is axially hollow and supports the sleeve at the end. The male wet connector is on the interior of a surrounding capsule 106 which extends from the very forward end of the male wet connector 70. More will be noted concerning the construction of this hereinafter. At the forward end of the capsule 106, a muscle support 107 is located on the interior and spaced from a muscle 108. The muscle is likewise supported by an exposed muscle support 109. The muscle backings 107 and 109 are preferably identical in construction and nature differ primarily in their location. They are arranged along a center line axis of the male wet connector. They permit the probe 101 to slide therethrough providing a small closable orifice which expands for extrusion. They are both supported on the interior of the capsule 106. They are assembled together by retaining rings such as the ring 110.

In the position illustrated in FIG. 5, the probe 101 is totally isolated. It is protected by a surrounding bath of non-conductive cleaning liquid. The liquid is retained on the interior of the muscle 108 because the muscle is able to close. When relative movement occurs between these components, the male connector 101 is pushed through the muscle 108 which wipes the male connector dry and removes any trash which might prevent proper electrical contact. Such movement is achieved by supporting the capsule 106 integrally with an initial alignment forward of a capsule sleeve 111. The sleeve supports on its exterior a piston ring 117 with a spring and pressure balance system to be described. In turn, there is also an internal seal 113 on the interior of the capsule 106 which enables the capsule to slide on the piston rod 105. The piston ring 117 supports seals at 112, 114 and also at 115. A compressible coil spring 116 is located on the exterior of the capsule 106 at two locations, one above and the other below the movable ring 117. The ring 117 has upper and lower shoulders facing duplicate centering springs 116. The piston ring 117 assures a pressure balance across the system. On the bottom side of the ring 117, drilling mud and thus ambient well pressure is observed. On the top side, the seal ring is exposed to fluid on the exterior of the capsule 106. This pressure is also observed on the interior of the capsule through a flow path to be discussed.

The capsule fits within a surrounding housing 118. The housing 118 encloses a capsule portion below a port 119. The port 119 thus communicates from the annular space on the interior of the housing 118 and above the piston ring 117. The port 119 opens to the interior of the capsule. The interior is filled with the liquid 120. This liquid completely surrounds the probe 101.

The capsule is movable with respect to the probe 101. It is movably supported on the rod 105. In other words, the entire capsule 106 from the seal at 113 to the outer muscle backing 109 moves as a unit so that the probe 101 is exposed. The probe 101 is mounted so that it may recoil or give slightly to accommodate variations in length of the two connectors when brought together. It includes the enlargement 102 fixed to the lower end which in turn connects with an extension sleeve 122 forced upwardly by a spring 123. The spring yields momentarily when the probe 101 is bumped during connection but restores it to the illustrated position. The downward travel of the probe 101 is relatively small in contrast with downward travel of the capsule 106 which surrounds the structure. Downward movement of the probe 101 compresses a fluid 124 on the interior of the rod. The seal 141 isolates the fluid 120 to prevent mixing with the fluid 124. The several conductor pairs that are necessary to complete circuitry through the male connector have been omitted from the drawings for sake of clarity. Thus, they extend from the enlargement 102 and along the passage 125 on the interior of the rod 105. This fluid is an electrical insulator and is included to provide a protective bath for the various conductors. This fluid is compressed in an enlarged chamber 126 at the lower end of the housing 118. The chamber 126 encloses suitable electrical feedthrough fittings 127 incorporated for the purpose of providing conductor paths through the remainder of the equipment. The chamber 126 is expandable. For the sake of convenience, the rod 105 connects serially with an extension rod 128. In like fashion, the outside housing 118 terminates but also an extension housing 142 extends therebelow. Thus, the extension housing 142 surrounds the rod 128. In the annular space between these two members, a circular piston 129 is located to isolate pressure fluids thereabove and therebelow. Suitable seal rings are incorporated at the internal and external faces. The piston 129 is balanced between a pair of springs at 130 and 131. Above the piston, ambient pressure is observed wherein the annular space is filled with drilling mud. Below the piston, the insulating fluid 126 is located. Thus, a pressure balance is achieved in the fluid 126. The piston 129 is moved when there is a variation in position of the conductor 101 previously described.

As described to this point, the probe 101 is sheltered during ambient conditions. In a manner to be described, the capsule 106 is forced downwardly over the probe 101 to express the tip and wipe it clean. When this occurs, the capsule movement downwardly permits proper connector operation. Such downward movement is also accompanied by fluid pressurization whereby the piston 129 is moved to another position as equalization is accomplished. As will be observed, appropriate ports in the housing 118 and the housing extension 142 deliver fluid from the bore hole into the tool to assure pressure equalization.

At the upper end of the apparatus, a cylindrical shroud 135 threads at its lower end to the housing 118. The shroud is larger than the capsule 106 and fits around it. It has an internal rotating ring 136 in a groove. The ring supports protruding lugs 137 at spaced locations suitable for engaging a J-slot as will be described. This shroud 135 is fixed and cannot move. In operation, the capsule 106 can move downwardly by a significant range while the probe 101 can move down only slightly because it has a limited range of travel. Capsule movement is resisted by a return spring 138.

The return spring 138 forces the capsule upwardly. Downward movement of the capsule is involved in exposing the male probe 101 for proper electrical connection.

Two fluids are separated from one another. Both are electrically insulated fluids. The fluid 120 surrounds the probe 101 and serves as a cleaning fluid to wipe and clear the surface for proper electrical connection. The fluid 126 is an electrical insulator also but is not required to serve as a cleaning fluid. Rather, it is incorporated to assure electrical insulation for the various wires extending along the hollow rod 105 and connecting with the feedthroughs 127. The feedthroughs 127 connect through the supporting bulkhead 139 which isolates the male wet connector system from the remainder of the logging tool located therebelow. As will be understood, all of the apparatus below the bulkhead 139 is electrically insulated and hermetically sealed.

DETAIL DESCRIPTION OF THE FEMALE WET CONNECTOR

Figure 6A:
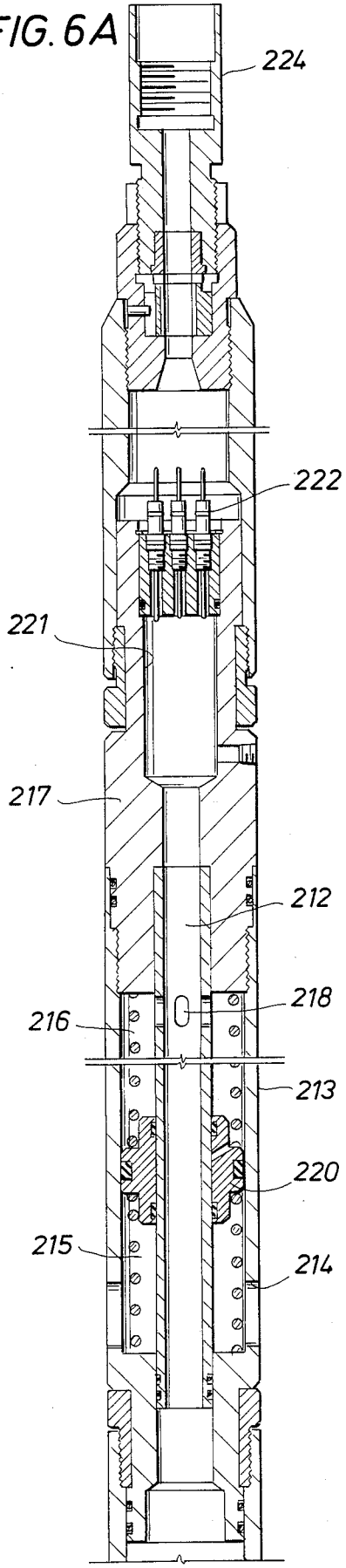
FIGS. 6A and 6B is the female wet connector supported on the logging cable shown in FIG. 1 and adapted to connect with the male wet connector shown in FIG. 5.
Figure 6B:
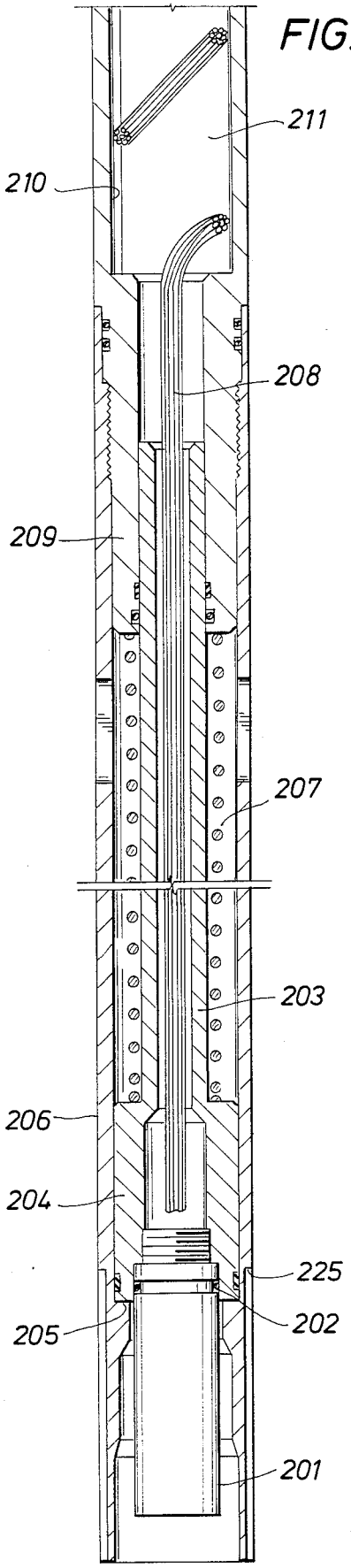

Attention is now directed to FIG. 6 of the drawings which shows the female wet connector 30, and more particularly shows the support structure which enables the wet connector to make connection. The reference numerals 30 and 70 refer to the entire structures shown in FIGS. 5 and 6. A suitable wet connector system is described in U.S. Pat. No. 4,373,767. The present system enables the mating connector elements 30 and 70 to come together so that proper multiconductor pathway connection is achieved. In FIG. 6, the wet connector unit is identified at 201. It is sealed on the exterior by a seal ring 202 which prevents leakage to the interior of a mounting rod 203. The rod 203 has an enlargement or head 204 at the extreme end which abuts an internal shoulder 205 within a surrounding housing 206. The enlarged head 204 is forced toward the shoulder 205 by a coil spring 207. The rod 203 is axially hollow and encloses a set of conductors 208 on the interior. The rod is permitted to telescope by sliding axially within a housing extension mmber 209. This encloses an enlarged chamber 210 which is filled with a fluid 211. This fluid surrounds the conductors 208 and protects them. It also serves as a hydraulic fluid to control operation of the female wet connector. That is, it damps movement of the wet connector 201. The multiple conductors are coiled into two or three turns received within the enlarged chamber 210.

The chamber 210 communicates therebeyond through a tubular extension 212 which is held within a surrounding outer housing member 213. They are spaced apart to find an annular space therebetween. The housing is perforated at 214 to enable drilling fluid to enter the annular space and thereby accomplish pressure equalization as will be described. In the annular space, a spring 215 is compressed. A similar spring 216 is located in the same annular space on the opposite side of a piston 220, described below, the springs working against one another. The spring 216 shoulders against a housing member 217. The tubular member 212 has a set of perforations 218 that permit fluid 211 under pressure to flow into the annular space. This fluid fills the annular space to a pressure equalization piston 220. The piston 220 is equipped with suitable seals on the interior and exterior to seal and thereby prevent contamination of the fluid 211 with drilling mud.

The housing member 217 continues the structure shown in FIG. 6 and is axially hollow at 221 to provide access to a set of electrical feedthroughs 222. They provide conductor isolation and enable the electrical conductors 208 to connect with the feedthroughs and thereby provide signal continuation pathways to the remainder of the cable 15. At the very end of the tool, there is a fitting 224 which is constructed to receive the logging cable and weights better shown in one of the whereby connection is made.

Operation of the female wet connector is best understood by first describing certain operative features of this structure; thereafter cooperation with the male wet connector will be given. First of all, the female wet connector is constructed with features shown in the referenced patent 40 and thereby enable it to line up with the male connector. The wet connector 201 is centrally mounted so that axial alignment between the two connectors is achieved. It is mounted on the rod 203 which is able to slide. The housing 206 which surrounds the rod is fixed while the rod 203 is able to yield. When this occurs, there is some give in the system so that the female wet connector 201 is not jammed or banged violently when connection is made. Rather, the rod 203 telecopes compressing the fluid. The fluid flows out through the ports 218 into the annular space. The pressure balance piston 220 is repositioned in the annular space to acommodate this outflow. Pressure equalization is thus achieved. This assures that the rod 203 is able to yield and yet is forced back to the contact against the shoulder 205 previously mentioned. Size of the housing 206 should be noted. Here, FIG. 6 must compared with FIG. 5 of the drawings. The housing 206 is sized so that it is able to telescope over the capsule 106 of the male wet connector. That is, it fits tightly in the annular space around the capsule. Recall that there are pins 137 on the ring 136. This ring permits rotation so that the pins can be brought into alignment. In a typical arrangement, there are two such pins arranged at 180 degrees from one another. The pins 137 are constructed to match with matching J-slots 225 in the housing 206 of the female wet connector. When the female wet connector is brought internally within the end located shroud 135, the pins 137 are permitted to rotate until alignment is achieved with the J-slots 225. Other movements of the two connectors occur in a timed sequence which permits the two connectors to be latched together and electrical connection to be made as described below. This will be understood best on review of the operations described below.

CONNECTION OF THE MALE AND FEMALE WET CONNECTIONS

Connection and disconnection of the wet connectors operates in the following sequence. Beginning with connection, it should be noted that the male wet probe 101 is enclosed in the capsule 106. It is bathed in a nonconductive fluid which surrounds the male conductor 101 typically having six to ten conductive regions at the tip. The fluid in the capsule 106 is held and captured by the muscle 108 which is held closed by end located retainers 107 and 109. The male wet connector 101 is supported on the rod 105 and is axially central of the male housing 118. The capsule 106 is protected by the surrounding shroud 135 which threads to the housing 118. Pressure balance in this system is continued by the pressure balance piston 117. This pressure balance is sustained by a similar springs above and below the piston. The springs provide a balancing force on the pressure balance piston. The capsule and all the equipment within it is forced to the end of the apparatus shown in FIG. 5 by the compensating spring 138.

Fluid within the rod 105 is pressure compensated by the balancing piston 129. The probe 101 is constructed with an enlargement 102 at its base and is supported on the extension sleeve 122 to work against the compressed spring 123. This enables controlled yielding so that excessive mating forces do not damage the equipment. Any tolerances built up in the male and female systems is also tolerated by this construction.

At the opposite side, the female wet connector is supported on the telescoping centralizing rod 203 previously mentioned. It is forced towards the end of its surrounding housing by the compensating spring 207. Recall that the rod 203 is hollow, filled with the fluid 211, and operates in a pressure balanced state as a result of the balancing system 220 previously described.

At the time of attempting connection between the male and female connectors, it is assumed that the female wet connector shown in FIG. 6 supported beneath the sinker weights has been pumped down the drill string. The female wet connector assembly shown in FIG. 6 passes through the centralizers shown at the top of FIG. 4. The shroud 135 receives and engulfs the female wet connector latching assembly to initiate J-slot latching utilizing the inwardly directed pins 137 shown in FIG. 5. This external latching is initiated before wet connector operation. The female wet connector 201 then pushes on the capsule 106. The fluid within the capsule 106 is then pumped out through the port 119 which then permits the entire capsule 106 to slide relatively downwardly around the probe 101. Fluid escape from the capsule is accompanied by opening of the muscle 108 because the male component is forced through it. The muscle wipes the probe 101 and forms a dynamic seal around it and thus prevents escape of the fluid 120. As the end of the female wet connector 201 continues pushing against the muscle 108, the female wet connector forces the capsule 106 further down into the housing against the compensating spring 138. The female wet connector 201 is constructed with a similar muscle. Thus, the probe 101 is wiped a second time on entry into the female wet connector 201. On the interior, contact is made and the tapered probe 101 seats with the conforming surface whereby the several electrical conductive pathways are completely connected. In this sequence of operations, the probe 101 is sheltered at practically all points in time. There is a short interval where it is between the two muscles and is at that instant exposed to well fluids. However, that does not pose a problem because the traverse of the probe 101 is carefully protected by the two fluid baths which keep external fluids from interfering with proper electrical connection.

At some point, the compensating spring 138 is compressed to its maximum. The spring 138 is made weaker than the similar compensating spring 207. Entry of the female housing 206 is limited by a shoulder 140 below the J-slot pins 137. The two compensating springs provide continual force urging the male and female members toward one another. Particulate trash or debris around the capsule 106 and forward of the shoulder 140 will ordinarily flow away by means of circulation in this area. All the while, the two opposing compensating springs keep the components urged together.

Unlatching involves the opposite sequence of events. As the components are pulled apart, the capsule 106 is forced upwardly so that it completely envelopes the probe 101. This movement on the male side of the apparatus is accompanied by a relative retreat of the female wet connector 201. This is accomplished while the probe 101 is pulled from the female connector 201, wiped by the muscle at the end thereof, wiped by the muscle 108 shown in FIG. 5, and ultimately retracted to the sheltered position inside the capsule 106 and away from well fluid.

DESCRIPTION OF OPERATION

The description set forth below relates to operation of the entire system in a deviated well. Assume for purposes of description that the drill string has been pulled completely from the well prior to logging of a zone of interest. Assume further that the zone of interest is 1,000 feet in length along the deviated well and begins at a depth of 10,000 feet in the well and extends to 11,000 feet. Assume further that the well is highly deviated so that gravity will not draw the logging tool through the zone of interest. Further, assume that the well has been cased to a depth of at least 1,000 feet. In this circumstance, the following sequence of operations is undertaken. First of all, the logging tool 50 shown in FIG. 3 is assembled (actually comprising a number of individual logging systems). The tool 50 can include the section as shown in FIG. 3 but it can be altered from that particular deployment of logging instruments. The logging tool 50 is assembled in the housing 40 shown in FIG. 2. The protruding arm 43 is located opposite the slot 42 while the projecting pad 44 is positioned adjacent the slot 45 in the housing. The various rotating standoffs 41 are free to rotate. The logging tool 50 is connected with the male wet connector 70 previously mentioned. The equipment included in the protective housing 40 is assembled below the orientation sub assembly 35 adjacent to the locking standoff assemby 34. In turn, that is connected with a string of drill pipe to enable the logging tool to be pushed into the well.

Joints of drill pipe are added until the logging tool is located at a depth of 10,000 feet. At this juncture, the side entry sub 22 shown in FIG. 1 is assembled in the drill string. The logging cable 15 is routed through the side entry sub and the female connector 30 shown in FIG. 1 with the associated weight bar and cables is suspended in the drill string. Additional drill pipe is added until the logging tool 50 has been shoved by the string of drill pipe to a depth of 11,000 feet in the well. At this juncture, the drill pipe has pushed the logging tool beyond the zone of interest. Logging is thereafter accomplished during withdrawal. At the time the side entry sub is placed in the drill string, the logging cable 15 is on the exterior of the drill pipe at the top of the cased well and inside the pipe string below. The wet connector is pumped down for connection. The necessary additional pipe is added thereafter to shove the logging tool past the zone of interest. The side entry sub at this point is located about 1,000 feet below the well head.

Mud is pumped through the drill string to act on the piston 28 to force the female wet connector 30 through the drill string. It is forced through the pipe string until it passes through the orientation sub assembly 35 and into the centralization section 36. It is pressure driven into immediate contact with the male wet connector 70. Connection of the male and female wet connectors will be described below.

During the insertion of the drill string by forcing it into the well, no rotation is applied. None is needed and there is no advantage to rotating. As the well deviates, the protective housing 40 will point into the deviated section from the vertical and will eventually arrive at the zone of interest and travel to the far side of the particular zone (1,000 feet in thickness in this example). During this maneuver where the housing 40 moves from the original vertical position at the well head into a highly deviated position dependent on the pathway of the well, the housing 40 (equipped with the weights 39) seeks a position relative to the vertical wherein the weights are at the bottom of the hole. In other words, the housing 40 aligns and settles against the bottom side of the hole, and the annular clearance between the housing 40 and the hole is above the tool. Such positioning is permitted by operation of the orientation sub assembly 35. At this time, the locking standoff assembly 34 is pushed upwardly. It is free to rotate at this stage. The rotary standoffs are likewise free to rotate at this stage. Indeed, the housing 40 is supported on the rotating standoff assemblies so that the exterior is not scuffed.

Eventually, the housing 40 arrives at the far side of the zone of interest. (description of the side entry sub and wet connection operation is found elsewhere) When the first retraction movement occurs (occasioned by retrieval of a few feet of the drill string), the locking asesmbly 34 locks the facing shoulders constructed therewith. The rotating standoffs 41 likewise lock. Recall, however, that they are constructed to permit ratcheting movement. They are in contact with the sidewall, but, since the tool is now more aptly on its side, the rotary standoffs 41 actually hold the housing 41 slightly above or off the bottom sidewall of the hole. In other words, the tool is now more or less horizontal (depending on the angle of deviation) and is resting on the rotary standoffs along the length of the tool. At this juncture, the housing 41 has settled to the bottom of the hole and is no longer precisely centralized, but this is desirable so that all modes of testing procedures can be undertaken. In this state of affairs, the logging tool 50 within the housing 40 is then ready to be operated.

Recall that the female connector 30 is pumped down. Recall also that it is submerged in drilling fluid which completely fills the drill string and surrounds the male wet connector 70. The two connectors are brought toward one another. The female wet connector is centralized as it is brought into contact with the male wet connector. The two connectors are forced together. The female wet connector enters the shroud 135 surrounding the capsule 106. The capsule 106 is pushed back or axially along the rod 105 which supports the capsule. Focusing primarily on the capsule, it is forced back by the female connector. It is also forced to open. The muscle 108 is parted and the male probe 101 extends through the muscle. The male probe penetrates the muscle of the female wet connector also. These two muscles at this point are immediately adjacent to one another. Assuming that drilling fluid gets on the male probe 101, it is nevertheless wiped clean when it enters the female connector.

The two connectors are brought together as the female wet connector is pumped down. There is the risk of damage should the contact be violent. Recall also that the male probe 101 is supported on the rod 105 with a measure of slippage wherein the enlargement 102 is able to retract slightly against spring tension. This avoids jamming or bending of any of the equipment with a violent contact. In other words, the components are gently contacted to avoid damage, and the electrical connection is then made wherein the male probe 101 completes seating within the female connector.

Recall that both the male and female wet connectors are shock mounted and are able to retract or recoil. They are spring driven toward one another. They are held in immediate proximity by operation of the pins 137 cooperative with the J-slots previously mentioned. This enables the mechanical connection to be remote from the electrical connection. That is, mechanical connection is made through the J-slot and pin construction. Electrical connection is made as described above and is therefore through a separate means and mechanism. This enables a rugged mechanism connection to be made separate from the more delicate electrical connection.

At this point, electrical power can be applied through the system and into the logging tool 50. As appropriate, the arm 43 can be extended and the pad 44 activated so that they are in proper position for operation. Logging can then begin as the tool is pulled out of the zone of interest. In the example given, the tool must travel 1,000 feet or back to a depth of 10,000 feet in the well to complete logging of the zone of interest. Logging is completed as the drill string is removed joint by joint at the well head. As the drill string is pulled from the well, the logging cable is also pulled from the well, but it does not get in the way of removal of each joint of the drill string. This continues joint by joint until the drill string is disassembled above the side entry sub. When the side entry sub reappears at the well head, it is an indication that the zone of interest has been logged. It should be recalled that the zone of interest was 1,000 feet in width and that the side entry sub was located about 1,000 feet into the well by assembly of the drill string thereabove. The side entry sub is removed after unlatching the wet connectors and the logging cable is pulled with retraction to the side entry sub. This pulls the wet connector 30 out of the drill string. Thereafter, the only apparatus remaining in the well is the drill string below the side entry sub (without cable). The remaining pipe can be easily removed, and thereafter the logging apparatus is retrieved. The arm 43 protrudes because it normally extends outwardly during the logging sequence, but is typically electrically actuated so that it retracts. In like fashion, the rotary standoffs are locked against rotation, but this poses no problem during retrieval because the tool travels from the highly deviated position (where logging occurred) to hang vertically in the well where the rotary standoffs are not operative. The equipment more or less hangs free of contact with the sidewall of the borehole.

While the foregoing is directed to the preferred embodiment, the scope thereof is determined by the claims which follow.

What is claimed is:

1. A method of logging highly deviated well boreholes comprising the steps of:

(a) rotatively attaching a logging tool on the end of a string of drill pipe;

(b) pushing the logging tool along the borehole past a zone of interest in a deviated region wherein the logging tool is permitted to move against the low side of the well borehole;

(c) placing a weight along one side of the logging tool to enable the logging tool to be rotated by gravity relative to the low side of the deviated well borehole;

(d) pulling the logging tool past the zone of interest without rotating the logging tool during pulling relative to the low side of the borehole; and
(e) performing logging operations in the zone of interest by the logging tool with a fixed rotational position relative to the zone of interest.

2. The method of claim 1 including the steps of:
(a) placing a pivotal connection between the logging tool and pipe string to enable rotation about an axis along the pipe string;
(b) placing a standoff means adjacent the logging tool to support the logging tool wherein the standoff means permits rotation in two opposite directions;
(c) wherein said standoff means has first and second operative positions, being
(1) a freely rotating position, and
(2) a locked position;
(d) shifting said standoff means to the rotating position during the step of pushing the logging tool past the zone of interest; and
(e) during the step of pulling the logging tool through the zone of interest, placing said standoff means in the locked position to prevent rotation thereof.

3. The method of claim 2 wherein at least two standoff means are located along said logging tool at spaced locations, and including the step of independently operating all of said standoff means to a locked position to prevent logging tool rotation.

4. The method of claim 3 including the step of placing multiple standoff means along said logging tool at spaced distances.

5. The method of claim 1 including the steps of:
(a) positioning a wet connector at the lower end of the pipe string connected with the logging tool;
(b) connecting a side entry sub in the drill string at the well head;
(c) extending a logging cable on the exterior of the drill string from the well head and through the side entry sub;
(d) supporting a mating and cooperative wet connector on the logging cable below the side entry sub;
(e) pumping the mating connector and connected logging cable down through the pipe string to bring the mating connector into contact with the connector in the pipe string;
(f) connecting the two connectors together; and
(g) thereafter pulling the logging tool past the zone of interest while performing logging operations.

6. The method of claim 5 further including the step of adding drill pipe above the side entry sub after the logging cable has been connected with the logging tool through the mated connectors, wherein the addition of pipe joints at the well head to the pipe string pushes the logging tool along the borehole.

7. The method of claim 6 including the step of casing the well borehole to a specified depth prior to placing the logging tool in the well borehole, and extending the logging cable outside of the pipe string within the cased portion to a depth not exceeding the depth of the cased portion.

8. The method of claim 7 including the step of centralizing the connector on the logging cable, and guiding the two connectors along a common axis into contact with one another for mating connection.

9. The method of claim 8 including the step of enclosing electrical contacts of the connectors to exclude drilling fluid therefrom prior to making electrical connection with the two connectors.

10. The method of claim 6 including the step of yieldably mounting the connector relative to the logging tool to enable axial recoil on contact with the connector carried on the logging cable.

11. The method of claim 9 including the step of resiliently mounting electrical contacts in both of said connectors to enable resilient urging of said contacts toward one another after said connectors have been brought into contact with each other.

12. The method of claim 9 including the step of forming a separate mechanical connection to hold the mated connectors together.

13. The method of claim 12 wherein the mated connectors are surrounded by concentric telescoped tubular members and including the step of forming a mechanical connection between the telescoped tubular members.

14. A method of making a connection of male and female connectors submerged in drilling fluid to enable logging tool communication to the well head on conducting subsequent well logging operations in a well borehole comprising the steps of:
(a) positioning a first connector at the lower end of a pipe string connected to a logging tool centered within the pipe string;
(b) lowering on a logging cable a second connector for mating with the first connector wherein the logging cable is placed in the pipe string;
(c) bringing the first and second connectors together to mate and provide connection of the logging tool through the logging cable to the well head area; and
(d) resiliently movably mounting at least one of the connectors to provide for recoil as the connectors are brought together to prevent excessive contact between the first and second connectors.

15. The method of claim 14 wherein the first connector is a male connector and including the step of mounting the male connector on an elongate rod centrally of a surrounding pipe for movement wherein said rod and said male connector axially recoil on impact and resiliently return toward the second connector.

16. The method of claim 15 wherein said male connector includes an extending male probe and including the step of movingly mounting the male probe to recoil on impact.

17. The method of claim 15 including the step of positioning the male probe within a surrounding closed chamber and pushing on the closed chamber to force the male probe to emerge from the closed chamber.

18. The method of claim 17 further including the step of wiping the male probe on emerging from the closed chamber.

19. The method of claim 18 including the step of wiping the male probe a second time prior to mating with the female connector.

20. The method of claim 14 including the step of initially mounting said first connector axially of the logging tool, and axially aligning said second connector for movement toward said first connector, and pumping drilling fluid along the pipe string to force said connectors together for connection.

21. The method of claim 14 including the steps of:
(a) enclosing a female connector in a closed capsule filled with a fluid while excluding drilling fluids from entry into said closed capsule;

(b) enclosing a male connector cooperative with the female connector in a closed capsule filled with a fluid while excluding drilling fluid therefrom;

(c) wherein said male and female connectors comprise the first and second connectors respectively; and (d) forcing the male connector to emerge from the closed capsule surrounding the male connector and enter the closed capsule enclosing the female connector and achieving connection between the first and second connectors wherein the male connector cooperatively electrically connects with the female connector.

22. The method of claim 21 further including mounting the male connector on a centrally aligned resiliently positioned and mounted rod, and including the steps of recoiling the male connector away from the female connector on initial contact, and further including the step of guiding the recoil to move axially along and away from the female connector, and restoring the recoiled male connector after recoil.

23. The method of claim 22 wherein the recoil step is accompanied by compression of a fluid in a closed system wherein the fluid is pumped by recoil of the male connector and is resiliently urged back against the male connector to restore the male connector.

24. The method of claim 23 including the step of fastening the male and female connectors fixedly relative to one another by forming a mechanical connection separate from the electrically connection between the male and female connectors.

25. The method of claim 24 wherein the step of forming the mechanical connection is achieved external of the closed capsules surrounding the male and female connectors.

26. The method of claim 25 including the step of making the mechanical connection through two extending tubular housings concentric about and spaced from the closed capsules surrounding the male and female connectors.

27. The method of claim 21 further including the step of aligning the surrounding tubular housings for telescoping entry relative to one another and wherein telescoping movement locks said telescoping tubular members together.

28. An apparatus for logging a zone of interest beyond a deviated potion of a deviated well borehole, the apparatus comprising:

(a) means for rotatively mounting a logging tool on the end of a string of drill pipe;

(b) weight means along one side of the logging tool to enable the logging tool to be rotated by gravity relative to the low side of the deviated well borehole;

(c) standoff means adjacent to said logging tool to support said logging tool wherein the standoff means controllably permits rotation and wherein said standoff means includes a locked position and a freely rotating position for enabling said logging tool to be rotated by said weight means for alignment relative to the low side of the deviated well borehole;

(d) separate male and female connectors deployed on a logging cable and on said logging tool for controllable connection and disconnection to permit logging of the zone of interest by said logging tool wherein data from the logging tool is provided on the logging cable through said mated connectors during retrieval of said logging tool past the zone of interest.

29. The apparatus of claim 28 wherein said logging tool is received in a cylindrically aligned housing means surrounding concentrically said logging tool and said housing is serially connected with said pipe string.

30. The apparatus of claim 29 wherein said housing means incorporates slots therealong enabling laterally extending arms to extend from said logging tool toward the well borehole in the zone of interest.

31. The apparatus of claim 30 including a rotational sleeve coupled between said housing and said pipe string and comprising said means for rotative mounting of said logging tool to said pipe string.

32. The apparatus of claim 31 including a side entry sub in said pipe string for receiving said logging cable therethrough.

33. The apparatus of claim 29 wherein a centralizing means is axially connected in said pipe string above said logging tool.

34. The apparatus of claim 33 including a tubular member on the lower end of said logging cable, a mating and telescoping tubular member above said logging tool wherein said two tubular members are joined together by connective means therebetween.

* * * * *